US006168111B1

(12) United States Patent
Kayser et al.

(10) Patent No.: US 6,168,111 B1
(45) Date of Patent: Jan. 2, 2001

(54) FOLD-OUT FIN

(75) Inventors: Lyle D. Kayser, Aberdeen; T. Gordon Brown, Abingdon, both of MD (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 08/804,351

(22) Filed: Mar. 3, 1997

(51) Int. Cl.[7] ..... F42B 10/14
(52) U.S. Cl. ..... 244/3.29; 244/3.24
(58) Field of Search ..... 244/3.28, 3.27, 244/3.24, 3.29

(56) References Cited

U.S. PATENT DOCUMENTS

| | | | | |
|---|---|---|---|---|
| 3,602,459 | * | 8/1971 | Pesarini | 244/3.27 |
| 3,643,599 | | 2/1972 | Hubich | 102/4 |
| 3,986,684 | * | 10/1976 | Marburger et al. | 244/3.28 |
| 4,440,360 | * | 4/1984 | Hallstrom | 244/3.28 |
| 4,667,899 | * | 5/1987 | Wedertz | 244/3.28 |
| 4,796,835 | | 1/1989 | Galvin | 244/3.29 |
| 4,817,891 | | 4/1989 | Gaywood | 244/3.29 |
| 4,869,442 | * | 9/1989 | Miller | 244/3.28 |
| 4,884,766 | | 12/1989 | Steinmetz et al. | 244/3.27 |
| 5,082,203 | * | 1/1992 | Baubry | 244/3.28 |
| 5,085,381 | | 2/1992 | Spiroff et al. | 244/3.24 |
| 5,108,051 | | 4/1992 | Montet et al. | 244/3.28 |
| 5,158,509 | * | 10/1992 | Ebuagh et al. | 244/3.24 |
| 5,326,049 | * | 7/1994 | Rom et al. | 244/3.28 |

OTHER PUBLICATIONS

The Effect of Wrap–Around Fins on Aerodynamic Stability and Rolling Moment Variations, C.W. Dahike & J.C. Craft, Jul. 1973, Technical Report RD–73–17.

A Summary of Aerodynamic Characteristics for Wrap–Around Fins from Mach 0.3 to 3.0, Technical Report TD–77–5, James a Humphrey & Calvin W. Dahlke, Mar. 1, 1977.

An Improved Projectile Boattail, Part III, Memorandum Report No. 2644, Anders S. Platous, Jul. 1976.

Aerodynamics of Fin–Stabilized Projectiles at Moderate Spin Rates, Memorandum Report BRL MR–3965, Lyle D. Kayser, Apr. 1992.

* cited by examiner

*Primary Examiner*—Harold J. Tudor
(74) *Attorney, Agent, or Firm*—Paul S. Clohan, Jr.; William E. Eshelman

(57) ABSTRACT

A fold-out fin has a fin geometry defined by two cross-sectional cuts through the cylindrical projectile body, both cuts being parallel to the boattail surface. This geometry insures that the stowed fin assembly fits within the gun tube. This geometry also exhibits low drag and good aerodynamic behavior. Upon launch, the fins are deployed and then locked in the fully open position with a spring loaded pin.

14 Claims, 3 Drawing Sheets

FOLD-OUT FIN

BACKGROUND OF THE INVENTION

The present invention relates in general to fins for stablizing a projectile, and in particular to fins that fold out after a projectile is launched from a gun tube.

Stability of projectiles can be generalized in two categories. The first type, gyroscopically stabilized, relies on spin to provide gyroscopic forces that maintain projectile stability. The second type, statically stabilized, depends on the lift of the fins or cone aft of the center of gravity (cg) to statically stabilize the projectile. Static stability occurs when the center of pressure is aft of the cg.

The mission of the projectile normally dictates the stability criteria. Generally, a cargo carrying artillery projectile is spin stabilized and an anti-tank round is often fin stabilized since cargo is not an issue. Yet, artillery projectiles cannot be spin stabilized if they do not have the necessary inertial characteristics.

If a projectile body is made of a lightweight material such as aluminum, the axial moment of inertia may be too small or, if the projectile is too long, the transverse moment of inertia may be too large and spin stabilization cannot be achieved. If spin stabilization cannot be achieved, then the projectile must be designed to be statically stable, usually with the aid of fins.

For a sub-caliber sabot launched projectile, such as a long rod penetrator, fins can be rigidly attached to the body. However, for a full-bore projectile where cargo is important, fins must be hinged so that they can be deployed after exit from the gun tube. The fold-out fin configuration of the present invention provides static stability through a unique fin packaging and deployment technique.

Numerous munitions with deployable fins exist but they often have undesirable aerodynamic characteristics such as high drag and roll instabilities.

Full-bore fin stabilized projectiles exist in the U.S. Arsenal, yet minor drawbacks are associated with each. The Copperhead projectile and Tow missile family have similar fin configurations. The fins in each are stowed within the cylindrical body and flip-out from within the body longitudinally to the axis of the projectile. This method provides for good stability when deployed, yet requires four long voids in the projectile body for stowing. These voids effectively make a cross pattern in the boattail section. This cross pattern reduces the cargo capacity and can cause some structural concerns depending on payload weight. Although this type of fin has been proven to be effective, it's minimal cargo space makes it undesirable.

Projectiles with wrap-around fins such as the 2.75" rocket family have probably the most efficient fin packaging configuration. Yet, wrap-around fins can induce rolling moments and yawing moments. This behavior has been observed where the direction of roll changes at transonic speeds. Wind tunnel test results demonstrate transonic roll reversal. See Dahlke, C. W., Craft, J. C., "The Effect of Wrap-Around Fins on Aerodynamic Stability and Rolling Moment Variations," Technical Report RD-73-17, U.S. Army Missile Command Technical Report RD-73-17, July 1973.

A comprehensive set of data for the wrap-around fins at Mach numbers 0.3 to 3.0 has been reported. See Humphery, J. A., Dahlke, C. W., "A Summary of Aerodynamic Characteristics for Wrap-Around Fins from Mach 0.3 to 3.0," Technical Report RD-77-5, U.S. Army Missile Research and Development Command Technical Report RD-73-17, March 1977. Furthermore, and perhaps more important, the usual wrap-around fin has a rectangular shape with drag characteristics that are not optimal. In a scaled test with a similar fin configuration (fixed elliptical fin) to that of the invention, no adverse rolling moment was found and drag was considered low. See Kayser, L. D., "Aerodynamics of Fin-Stabilized Projectiles at Moderate Spin Rates," BRL Memorandum Report No. BRL-MR-3965, U.S. Army Ballistic Research Laboratory, Aberdeen Proving Ground, Maryland, April 1992.

Probably the most similar existing design is the Navy's Harpoon missile. Similar to the present invention, this configuration has a set of four flat fold-out fins that rest on a square boattail. Unlike the present invention, the fins are square in shape and hinged with a spring for deployment. The Harpoon fins are square to accommodate for the square boattail. This square boattail is machined parallel to the principle axis of the missile, thereby providing an abrupt discontinuity or step. This step causes a pressure drop which increases the drag. The present invention provides a smoother transition at the boattail and the resulting fin is elliptical, which provides better drag characteristics. The present invention also utilizes a very efficient fin packing configuration. Non-conical boattails without fins have been examined and were found to have better drag and stability characteristics than conventional boattails. See Platou, A. S., "An Improved Projectile Boattail. Part III," BRL Memorandum Report No. 2644, U.S. Army Ballistic Research Laboratory, Aberdeen Proving Ground, Maryland, July 1976, AD# B012781.

Some advantages of the present invention over previous designs include:

1. Good drag characteristics (low fin drag, improved boattail drag),
2. Efficient fin packaging,
3. No adverse rolling moment, and
4. Use of spin for fin deployment, i.e., no active deployment mechanisms needed.

SUMMARY OF THE INVENTION

It is an object of the present invention to provide a fold-out fin with a low drag configuration which avoids adverse aerodynamic behavior.

This and other objects of the invention are achieved by a projectile for launching from a gun tube, comprising a cylindrical projectile body having a longitudinal axis and a tapered non-conical boattail; at least two elliptical fins, each fin having a size and a shape defined by two parallel planes that intersect the projectile body at an angle parallel to the boattail, thereby insuring that the projectile with folded fins fits in the gun tube; and hinges for connecting the fins to the boattail.

Other objects, features and advantages of the invention will become apparent from the following detailed description taken in conjunction with the accompanying drawings.

DETAILED DESCRIPTION OF THE PREFERRED EMBODIMENTS

The present invention utilizes both a non-conical boattail and a flip-out fin design for an optimized fin area. In the present invention, the fin rests in the flat section of the removed volume that makes up the tapered non-conical boattail. This arrangement allows for a full caliber projectile with little loss of cargo space. At least two fins are required on each projectile body. Three, four or five fins may be used, with the geometry of the boattail varying with the number of fins.

Figure 1:
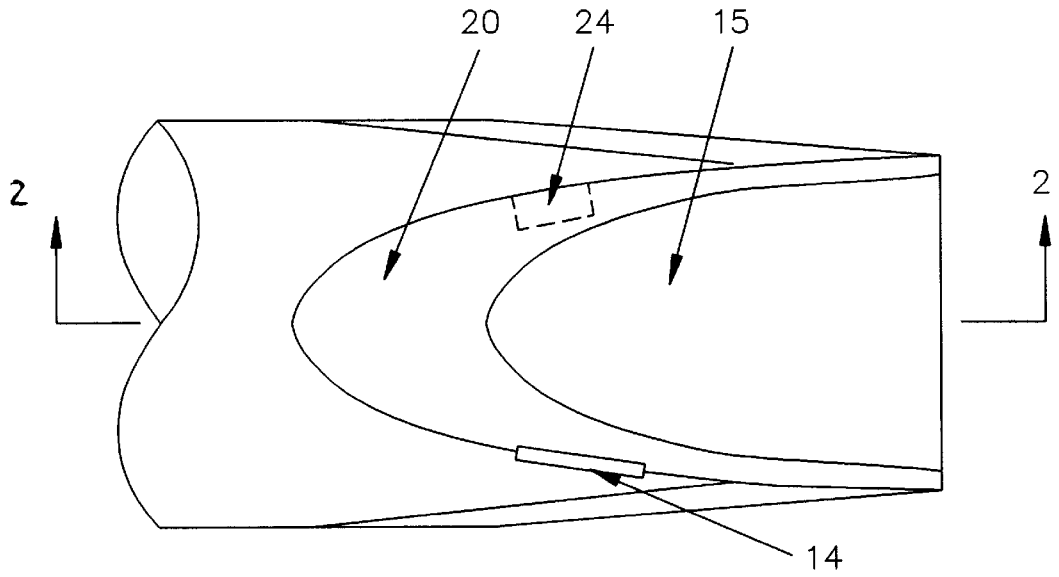
FIG. 1 is a top view of a stowed fin assembly and boattail according to the invention.
Figure 2:
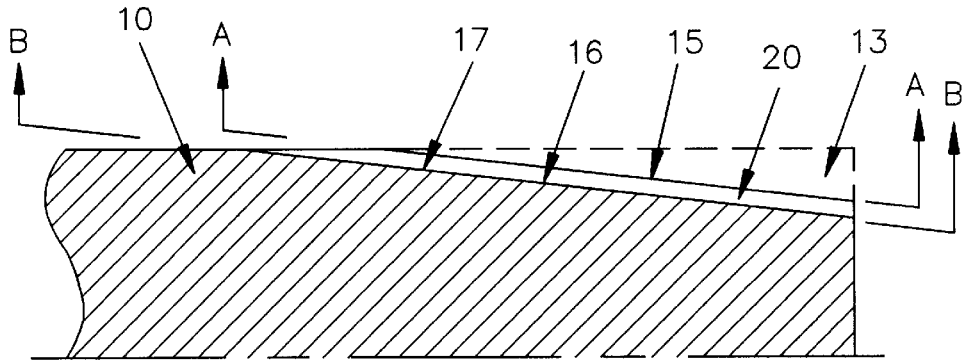
FIG. 2 is a sectional side view of the stowed fin assembly and boattail taken along the line 2—2 in FIG. 1.

The fin geometry is defined by making two parallel cuts through a cylindrical projectile body 10 as shown in FIGS. 1 and 2. The first cut, indicated by cross section A—A, defines a section 13 of the cylinder which is discarded and also defines the outer surface 15 of the fin 20. The second cut, indicated by the cross section B—B forms the inner surface 16 of the fin and also forms a tapered non-conical boattail surface 17.

The two surfaces 16 and 17 are in contact before the projectile exits the tube. The volume between the cross sections A—A and B—B is the fin 20. Defining the fin 20 in this way insures that the stowed fin assembly fits within the gun tube. The thickness of the fin is defined by the two cross sections and is variable within the physical constraints of the diameter and length of the boattail. The fin 20 may be made of, for example, aluminum or composite materials. The fin may be manufactured by, for example, molding, welding, or extruding. The fin may be heat treated to vary its mechanical properties. The hinge mechanism 14 is shown in greater detail in FIG. 5.

Figure 3:
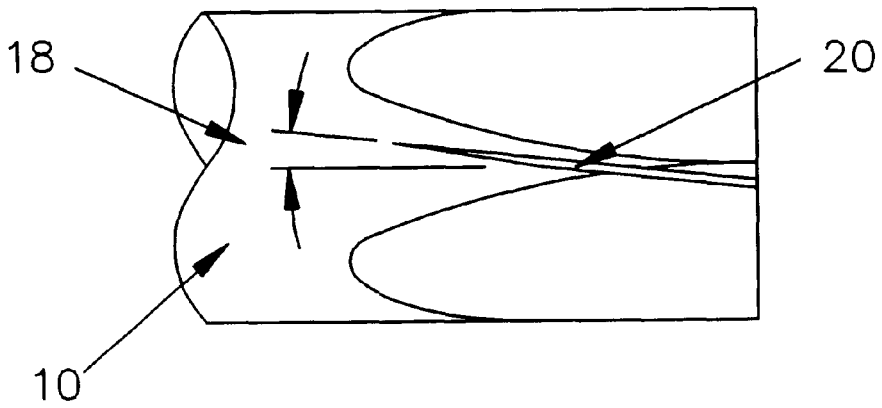
FIG. 3 is a top view of a deployed fin assembly and boattail according to the invention.
Figure 4:
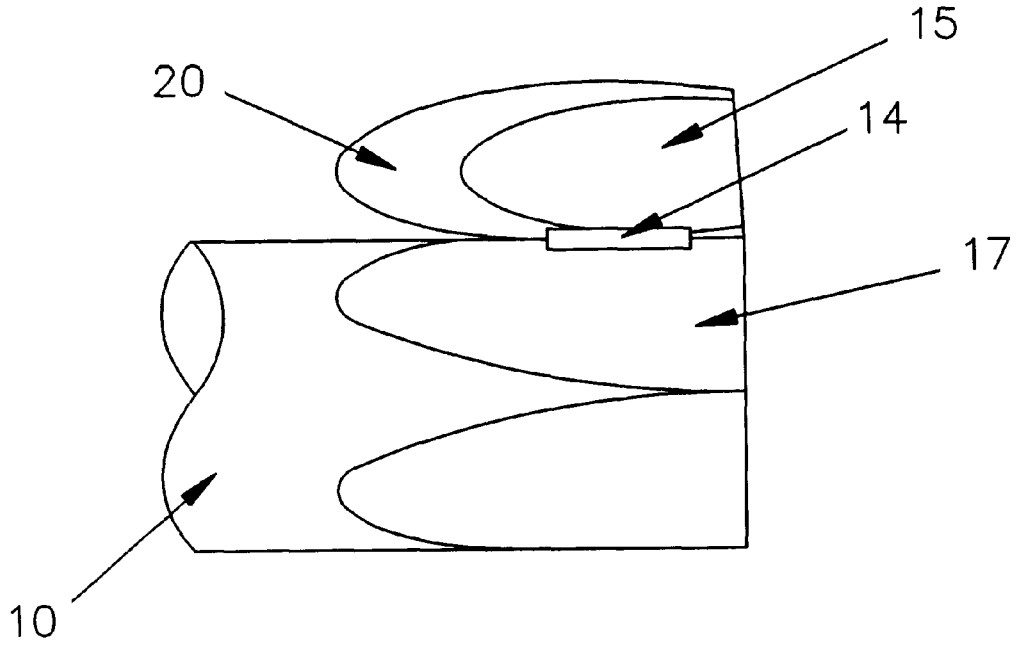
FIG. 4 is a side view of FIG. 3.

FIGS. 3 and 4 show the fin 20 in the deployed position. In FIGS. 3 and 4, the projectile body 10 is rotated 45 degrees with respect to FIGS. 1 and 2. If the fin plane is normal to the cylindrical surface 17 when in the deployed position, then the fin 20 must rotate through an angle of approximately 135 degrees during deployment. The fin cant angle 18 may be varied by changing the hinge-line angle when the fin is manufactured. Preferably, each fin has a sharp leading edge and swept back sides. Furthermore, a cant angle of each fin is preferably seven degrees.

Figure 5:
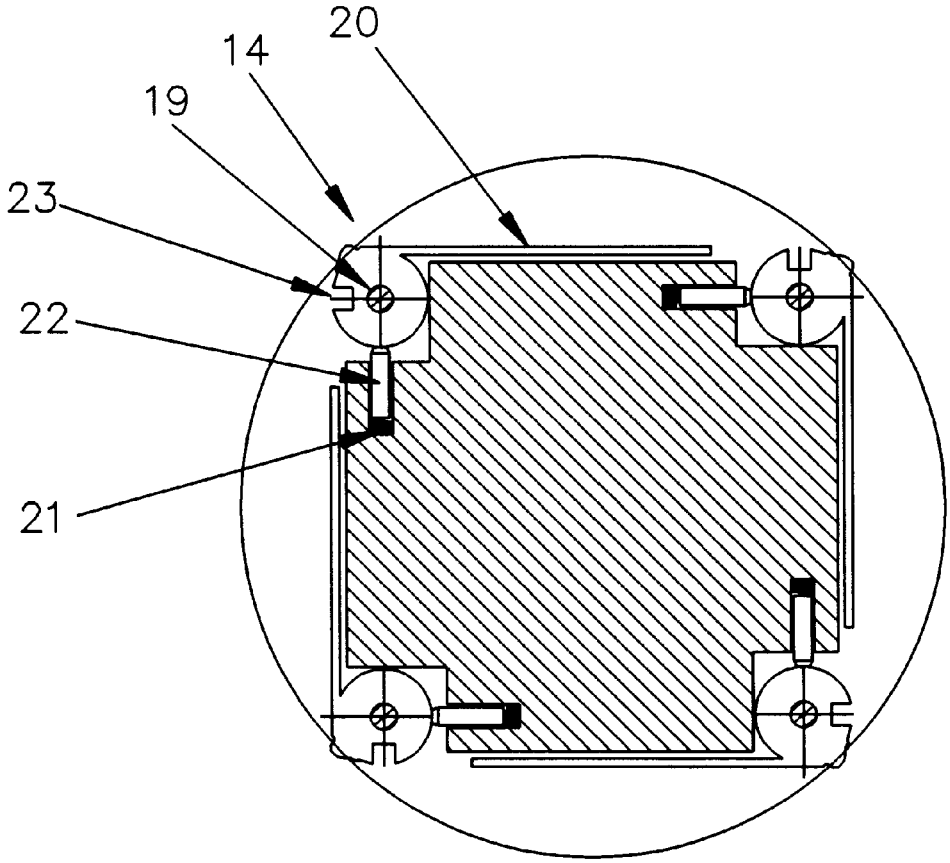
FIG. 5 is a sectional view of the invention showing the hinge mechanism.

A cross-sectional view of the hinge mechanism 14 is shown in FIG. 5. After launch, the fins 20 are deployed by rotating the fins 20 about the hinge line pin 19 (in FIG. 5 the hinge line pin 19 is approximately perpendicular to the drawing). As the fin 20 reaches the fully deployed position, springs 21 force the locking pins 22 into the cylindrical notches 23. Once the pins 22 are engaged in the notches 23, the fins 20 are locked in place.

The hinge line pin 19 and the locking pins 22 may be made of, for example, steel. The hinge line pins 19 are fitted in holes in the boattail on either side of the hinge mechanism 14.

Fin deployment is accomplished through the use of centrifugal forces. The projectile or missile acquires adequate spin in the launch tube to allow centrifugal forces to cause the fins to rotate out and lock in place (deploy) after exit from the tube. This concept was conceived using physical laws of mechanics and an analytical model was developed to predict the fin motion as a function of time. The analytical model was verified by experiment in which a physical model was rotated at a constant spin rate, the fins were released, and motion was recorded by high speed camera.

If inadequate spin or no spin is available at launch, fin deployment can be accomplished by use of an active mechanism 24 (schematically shown in FIG. 1), which uses springs, pneumatics, or other stored energy device.

In summary, the fin geometry is defined by two cross-sectional cuts through the cylindrical projectile body 10, parallel to the boattail surface (FIGS. 1 and 2). This insures that the stowed assembly fits within the gun tube. This configuration also exhibits low drag and good aerodynamic behavior. Upon launch, the fins 20 are deployed and then locked in the fully open position (FIGS. 3 and 4) with a spring loaded pin 22.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile comprising:

a cylindrical projectile body having a longitudinal axis and a tapered non-conical boattail;

at least two elliptical fins, each of the fins having a size and a shape defined by two parallel planes that intersect the projectile body at an angle parallel to the boattail; and hinges for connecting each of the fins to the boattail.

2. The projectile of claim 1, further comprising an active mechanism connected to the boattail for deploying the fins.

3. The projectile of claim 1, wherein each fin has a sharp leading edge and swept back sides.

4. The projectile of claim 1, further comprising locking mechanisms for locking in place the fins when the fins are deployed.

5. The projectile of claim 4, wherein each locking mechanism comprises:

a spring disposed in an opening in the boattail;

a locking pin which engages the spring; and a notch in the fin for receiving the locking pin when the fin is deployed.

6. The projectile of claim 5, wherein a cant angle of each fin is seven degrees.

7. The projectile of claim 1, wherein the fins are made of aluminum.

8. A projectile for launching from a gun tube, comprising:

a cylindrical projectile body having a longitudinal axis and a tapered non-conical boattail;

at least two elliptical fins, each fin having a size and a shape defined by two parallel planes that intersect the projectile body at an angle parallel to the boattail, the projectile with folded fins having a diameter such that it fits in the gun tube; and hinges for connecting the fins to the boattail.

9. The projectile of claim 8, further comprising an active mechanism connected to the boattail for deploying the fins.

10. The projectile of claim 8, wherein each fin has a sharp leading edge and swept back sides.

11. The projectile of claim 8, further comprising locking mechanisms for locking in place the fins when the fins are deployed.

12. The projectile of claim 11, wherein each locking mechanism comprises:

a spring disposed in an opening in the boattail;

a locking pin which engages the spring; and a notch in the fin for receiving the locking pin when the fin is deployed.

13. The projectile of claim 12, wherein a cant angle of each fin is seven degrees.

14. The projectile of claim 13, wherein each fin is made of aluminum.

* * * * *